US007695105B2

(12) United States Patent
Sung et al.

(10) Patent No.: US 7,695,105 B2
(45) Date of Patent: Apr. 13, 2010

(54) NOZZLE PLATE, INKJET PRINTHEAD WITH THE SAME AND METHOD OF MANUFACTURING THE SAME

(75) Inventors: Gee-young Sung, Daegu-si (KR); Kye-si Kwon, Seoul (KR); Seong-jin Kim, Seongnam-si (KR); Keon Kuk, Yongin-si (KR); Seung-joo Shin, Seoul (KR); Seog-soon Baek, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 930 days.

(21) Appl. No.: 11/260,226

(22) Filed: Oct. 28, 2005

(65) Prior Publication Data

US 2006/0092224 A1 May 4, 2006

(30) Foreign Application Priority Data

Oct. 29, 2004 (KR) ..... 10-2004-0087038

(51) Int. Cl.
*B41J 2/14* (2006.01)
*B41J 2/045* (2006.01)

(52) U.S. Cl. ..... 347/47; 347/68

(58) Field of Classification Search ..... 347/45, 347/47, 68

See application file for complete search history.

(56) References Cited

U.S. PATENT DOCUMENTS

| | | | | |
|---|---|---|---|---|
| 6,176,569 | B1 * | 1/2001 | Anderson et al. | 347/57 |
| 6,213,595 | B1 | 4/2001 | Anagnostopoulos et al. | |
| 6,439,703 | B1 | 8/2002 | Anagnostopoulos et al. | |
| 6,561,626 | B1 * | 5/2003 | Min et al. | 347/47 |
| 2002/0085069 | A1 | 7/2002 | Anagnostopoulos et al. | |
| 2003/0016272 | A1 | 1/2003 | Anagnostopoulos et al. | |
| 2006/0012638 | A1 * | 1/2006 | Lee | 347/58 |

FOREIGN PATENT DOCUMENTS

| | | | |
|---|---|---|---|
| EP | 1 016 526 | A1 | 7/2000 |
| EP | 1 176 012 | A2 | 1/2002 |
| EP | 1 176 012 | A3 | 1/2002 |
| JP | 2000-190509 | | 7/2000 |
| JP | 2002-254653 | | 9/2002 |
| KR | 10-2002-0001099 | | 1/2002 |

* cited by examiner

*Primary Examiner*—An H Do
(74) *Attorney, Agent, or Firm*—Lee & Morse, P.C.

(57) ABSTRACT

A nozzle plate, inkjet printhead with the same and method of manufacturing the same. The nozzle plate includes at least one nozzle and has at least one heater segment disposed adjacent to the nozzle. The heater segment is configured to heat a first fraction of the circumference to a greater degree than a second fraction of the circumference. Heater segments are disposed at intervals around a circumference of the nozzle and are independently operable.

15 Claims, 6 Drawing Sheets

NOZZLE PLATE, INKJET PRINTHEAD WITH THE SAME AND METHOD OF MANUFACTURING THE SAME

BACKGROUND OF THE INVENTION

1. Field of the Invention

The present invention relates to an inkjet printhead. More particularly, the present invention relates to an inkjet printhead with a nozzle plate designed to control an ejecting direction of ink droplets ejected through a nozzle. The present invention further relates to a method of manufacturing such a nozzle plate.

2. Description of the Related Art

Generally, an inkjet printhead is a device for printing a color image on a surface of an object by ejecting droplets of ink on a desired location of the object. Such an inkjet printhead may be classified, according to an ink ejecting method, into a thermal inkjet printhead and a piezoelectric inkjet printhead.

In the thermal inkjet printhead, ink is quickly heated by a heater, formed of a heating element, when a pulse-type current is applied to the heater. As the ink is heated, the ink is boiled to generate bubbles. The bubbles expand and apply pressure to ink in a pressure chamber, thereby ejecting ink out of the pressure chamber through a nozzle in the form of droplets. However, the thermal inkjet printhead has to heat the ink to a high temperature, e.g., several hundred degrees Celsius or more, to generate bubbles, thereby resulting in high energy consumption and thermal stress therein. Also, it is hard to increase the driving frequency of the thermal inkjet printhead because the heated ink does not readily cool down.

In the piezoelectric inkjet printhead, a piezoelectric material is used. A shape transformation of the piezoelectric material generates pressure, thereby ejecting the ink out of a pressure chamber.

FIG. 1 shows a typical piezoelectric inkjet printhead. Referring to FIG. 1, a passage plate 10 is provided with an ink passage including a manifold 13, a plurality of restrictors 12 and a plurality of pressure chambers 11. A nozzle plate 20 is provided with a plurality of nozzles 22 corresponding to the plurality of pressure chambers 11. A piezoelectric actuator 40 is disposed on the passage plate 10. The manifold 13 functions to dispense the ink from an ink storage region (not shown) to the plurality of pressure chambers 11. The restrictor 12 functions as a passage through which the ink is introduced from the manifold 13 to the pressure chamber 11. The plurality of the pressure chambers 11, which store ink to be ejected, are arranged on one or both sides of the manifold 13. The plurality of pressure chambers 11 vary in their volumes as the piezoelectric actuator 40 is driven, thereby generating pressure variations to eject ink through the nozzles and suck ink from the manifold. To realize this, a portion of the passage plate 10 which defines a top wall of each pressure chamber 11 is designed to function as a vibration plate 14 that is to be deformed by the piezoelectric actuator 40.

The piezoelectric actuator 40 includes a lower electrode 41 disposed above the passage plate 10, a piezoelectric layer 42 disposed on the lower electrode 41, and an upper electrode 43 disposed on the piezoelectric layer 42. Disposed between the lower electrode 41 and the passage plate 10 is an insulating layer 31, e.g., a silicon oxide layer. The lower electrode 41 is formed all over the top surface of the insulating layer 31 to function as a common electrode. The piezoelectric layer 42 is formed on the lower electrode 41 and is located above the pressure chambers 11. The upper electrode 43 is formed on the piezoelectric layer 42 to function as a driving electrode applying voltage to the piezoelectric layer 42.

When an image is printed using the above-described typical inkjet printhead, the resolution of the image is affected by the number of nozzles per inch. Here, the number of nozzles per inch is represented by "Channel per Inch (CPI)" and the image resolution is represented by "Dot per Inch (DPI)." The improvement of the CPI in the typical inkjet printhead generally depends on improvements in materials processing technologies, actuator improvements, etc. However, the improvement of the CPI may not keep up with demands for increasingly higher resolution (DPI) images. Therefore, a variety of technologies for printing a higher DPI image using a low CPI printhead have been developed. FIGS. 2 and 3 show examples of those technologies.

According to one example, depicted in the upper portion of FIG. 2, a plurality of nozzles 51 and 52 are arranged along two or more rows. As illustrated, the nozzles 51 arranged along a first row and the nozzles 52 arranged along a second row may be staggered. Using this array of nozzles 51 and 52, the droplets ejected from the nozzles 51 and 52 print an image, while forming a single line, as depicted in the lower portion of FIG. 2. That is, dots 61 formed by the nozzles 51, which are arranged along the first row, and the dots 62 formed by the nozzles 52, which are arranged along the second row, alternate on a print medium 60. Therefore, the image DPI formed on the print medium 60 is two times the CPI of the printhead 50.

However, in order to precisely print the image, the nozzles 51 and 52 must be arranged accurately along the respective rows. Therefore, there is a need for an arrangement system that can precisely arrange the nozzles 51 and 52. This increases the size and cost of the printhead.

According to another example, depicted in FIG. 3, the printing is performed by a printhead 70 having a low CPI and inclined at a predetermined angle Θ with respect to a print medium 80. That is, the printhead 70 is not perpendicular to a direction of travel of the print medium 80, but rather is rotated from the perpendicular by the angle Θ. As a result, intervals between dots 81 formed on the print medium 80 are less than intervals between the nozzles 71 along the printhead 70. Thus, the image DPI on the print medium 80 is higher than the CPI of the printhead 70. In this case, the greater the inclined angle Θ, the higher the DPI. However, inclining the printhead 70 foreshortens the effective coverage of the printhead 70 on the print medium 80. That is, the printing area is reduced such that, in order to obtain a printing area equal to that obtained by an uninclined printhead, the length of the printhead 70 must be increased.

SUMMARY OF THE INVENTION

The present invention is therefore directed to an inkjet printhead with a nozzle plate that is designed to control an ejecting direction of ink droplets ejected through a nozzle and a method of manufacturing such a nozzle plate, which substantially overcome one or more of the problems due to the limitations and disadvantages of the related art.

It is therefore a feature of an embodiment of the present invention to provide an inkjet printhead with a nozzle plate that includes a heater designed to control an ejecting direction of droplets of ink ejected through a nozzle, thereby printing a high resolution image.

It is therefore another feature of an embodiment of the present invention to provide a nozzle plate including a heater to partially change a surface tension of fluid in the nozzle by partially heating the fluid.

At least one of the above and other features and advantages of the present invention may be realized by providing a nozzle plate with at least one nozzle, the nozzle plate including at least one heater segment disposed adjacent to the nozzle.

The nozzle has a circumference and the heater segment may be configured to heat a first fraction of the circumference to a greater degree than a second fraction of the circumference. The nozzle plate may include at least two heater segments disposed at intervals around a circumference of the nozzle, each of the at least two segments being independently operable. The nozzle plate may include four segments disposed at 90 degree intervals around the circumference of the nozzle.

The nozzle plate may further include a substrate defining the nozzle and on which the heater segments are formed, electrodes that are electrically coupled to the heater segments, and an insulating layer formed on the substrate and covering the heater segments and the electrodes. The substrate may be formed of a base substrate for a printed circuit board. The heater segments may be formed of a material chosen from the group consisting of TaAl and TaN. The insulating layer may be formed of photo solder resist.

At least one of the above and other features and advantages of the present invention may also be realized by providing an inkjet printhead including a passage plate including an ink passage having a plurality of pressure chambers, a piezoelectric actuator formed on a surface the passage plate, and a nozzle plate formed on a surface of the passage plate and defining a plurality of nozzles coupled to corresponding ones of the plurality of pressure chambers, wherein the nozzle plate includes at least one heater segment disposed adjacent to each of the plurality of nozzles.

The nozzle plate may include at least two heater segments disposed at intervals around a circumference of the nozzle, each of the at least two segments being independently operable. The nozzle plate may include four segments disposed at 90 degree intervals around the circumference of the nozzle.

The nozzle plate may further include a substrate defining the plurality of nozzles and on which the heater segments are formed, electrodes that are electrically coupled to the heater segments, and an insulating layer formed on the substrate and covering the heater segments and the electrodes. The substrate may be formed of a base substrate for a printed circuit board. The heater segments may be formed of a material chosen from the group consisting of TaAl and TaN. The insulating layer may be formed of photo solder resist.

At least one of the above and other features and advantages of the present invention may further be realized by providing a method of manufacturing a nozzle plate having at least one nozzle, including forming an electrode on a substrate, forming a first insulating layer on the substrate to cover the electrode, patterning the first insulating layer to form a trench around a region in which the nozzle is to be formed, the trench partially exposing the electrode, depositing a resistive heating material in the trench to form a heater, forming a second insulating layer on the first insulating layer to cover the heater, and defining the nozzle inside the heater, the nozzle formed through the substrate, the first insulating layer and the second insulating layer.

The substrate may be formed of a base substrate for a printed circuit board. The heater may be divided into at least two segments that are arranged around the nozzle with a predetermined distance from the nozzle. The trench may be formed in the shape of an arc such that the heater does not completely encircle the nozzle and may be disposed proximate to the nozzle, such that heat generated by the heater heats one side of the nozzle preferentially.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
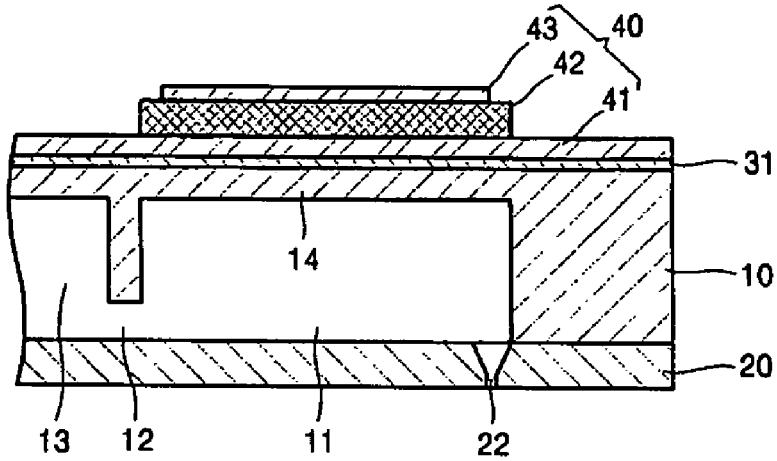
FIG. 1 (PRIOR ART)
FIG. 1 illustrates a schematic sectional view of a conventional inkjet printhead.
Figure 2:
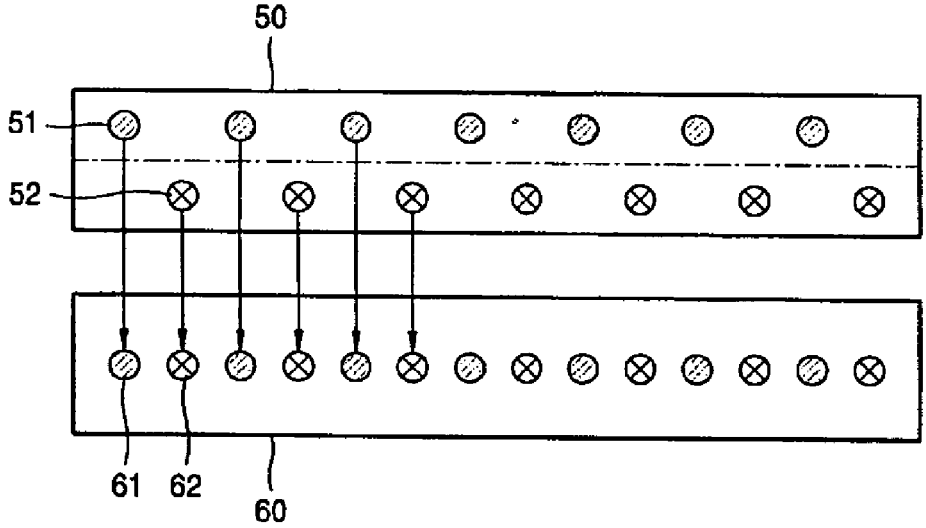
FIG. 2 (PRIOR ART)
FIGS. 2 and 3 illustrate schematic views of examples of technologies for printing a higher DPI image using a low CPI printhead.
Figure 3:
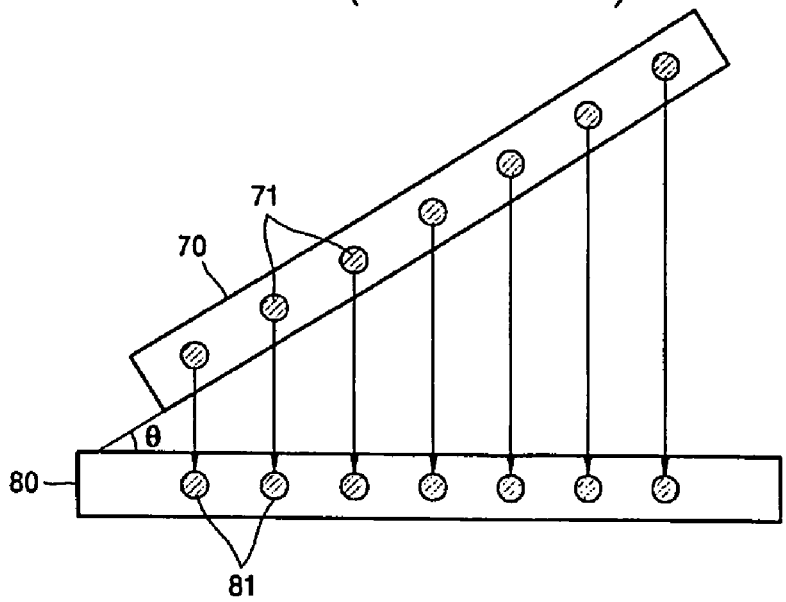
FIG. 3 (PRIOR ART)

Korean Patent Application No. 10-2004-0087038, filed on Oct. 29, 2004, in the Korean Intellectual Property Office, and entitled: "Nozzle Plate Unit, Inkjet Printhead with the Same and Method of Manufacturing the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

According to embodiments of the present invention, the direction of ink droplets ejected through a nozzle may be controlled by adjusting the surface tension of ink in the nozzle using a heater, such that a high resolution image can be printed using a printhead having a relatively low CPI.

The heater of the printhead may only heat the ink to a degree sufficient to change the surface tension of the ink, such that it consumes less power than a heater of a conventional thermal inkjet printhead. For example, the surface tension of the ink may be sufficiently changed by increasing the temperature of the ink by several tens of degrees Celsius.

The nozzle plate may be formed of a printed circuit board (PCB) base substrate to reduce manufacturing costs.

While the description provided herein provides a detailed description in the context of a piezoelectric inkjet printhead that ejects ink, it will be understood that the present invention may be suitable applied to a variety of other fluids and fluid ejecting systems.

Figure 4:
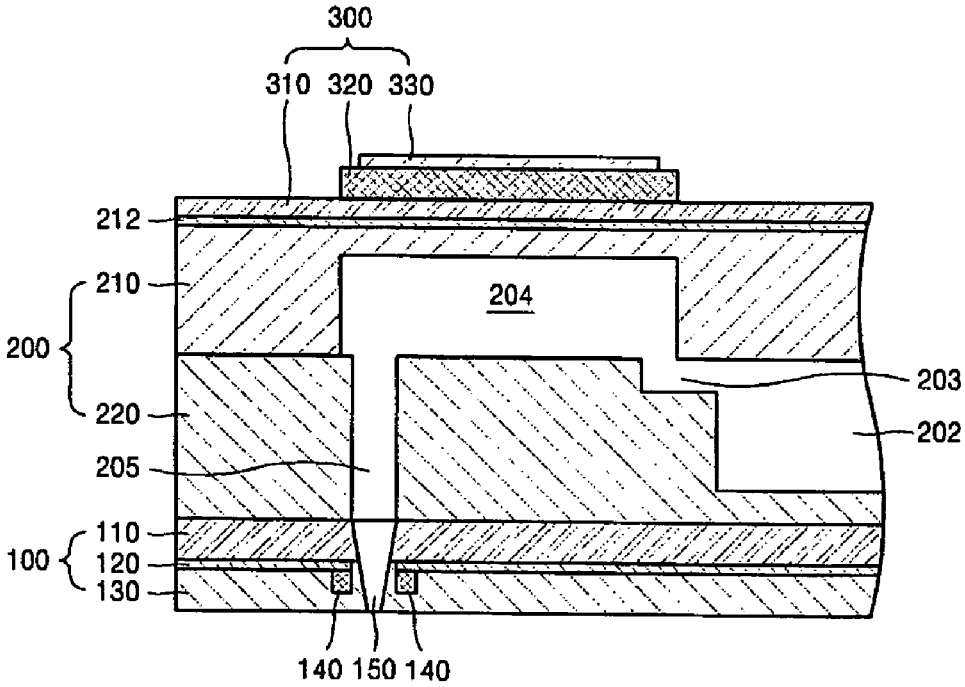
FIG. 4 illustrates a schematic vertical sectional view of an inkjet printhead according to an embodiment of the present invention.
Figure 5A:
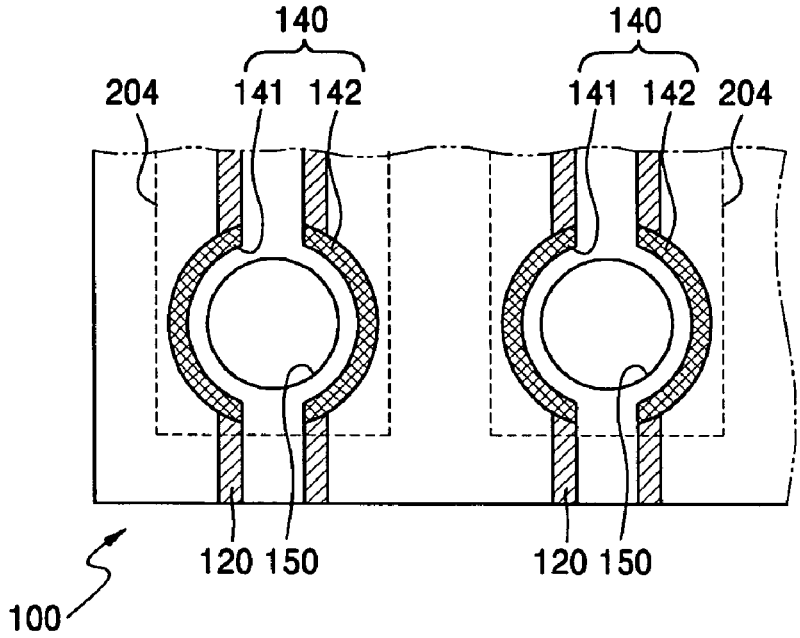
FIG. 5A illustrates an enlarged partial plan view of a heater that is provided on a nozzle plate according to an embodiment of the present invention.

FIG. 4 illustrates a schematic vertical sectional view of an inkjet printhead according to an embodiment of the present invention and FIG. 5A illustrates an enlarged partial plan view of a heater that is provided on a nozzle plate according to an embodiment of the present invention. Referring to FIGS. 4 and 5A, an inkjet printhead according to an embodiment of the present invention may include a passage plate 200 provided with an ink passage having a plurality of pressure chambers 204 and a piezoelectric actuator 300 disposed on a top surface of the passage plate 200 to apply a driving force for ejecting ink to the pressure chambers 204. The inkjet printhead may also include a nozzle plate 100 attached on a bottom surface of the passage plate 200 and provided with a plurality of penetration nozzles 150 to eject the ink out of the pressure chambers 204.

The ink passage may include, in addition to the plurality of pressure chambers 204, a manifold 202 functioning as a common passage supplying ink, which is introduced from an ink inlet (not shown), to the pressure chambers 204. The ink passage may also include a restrictor 203 functioning as an individual passage supplying ink from the manifold 202 to each pressure chamber 204. A damper 205 may be disposed between the pressure chamber 204 and the nozzle 150 to concentrate energy, which is generated in the pressure chamber by the piezoelectric actuator 300, on the nozzle 150 and to buffer sudden pressure variations. The elements defining the ink passage may be formed on the passage plate 200. Some portion of the passage plate 200 may define a top wall of the pressure chamber 204 and function as a vibration plate when the piezoelectric actuator 300 operates.

Specifically, as shown in FIG. 4, the passage plate 200 may further include first and second passage plates 210 and 220. The pressure chambers 204 may be formed on a bottom surface of the first passage plate 210 at a predetermined depth. The pressure chamber 204 may be formed in a rectangular shape having a longitudinal direction corresponding to the direction of ink flow between the manifold 202 and the nozzle 150.

The manifold 202 may be formed on the second passage plate 220. As shown in FIG. 4, the manifold 202 may be formed on a top surface of the second passage plate 220 at a predetermined depth. The manifold 202 may also be formed vertically penetrating the second passage plate 220 (this example is not shown). The restrictor 203 may be formed on the top surface of the second passage plate 220 at a predetermined depth to connect the manifold 202 to a first end of the pressure chamber 204. The restrictor 203 may be also formed vertically penetrating the second passage plate 220 (this example is not shown). The damper 205 may be formed vertically penetrating the second passage plate 220 and corresponding to a second end of the pressure chamber 204, so as to connect the pressure chamber 204 to the nozzle 150.

Although the elements constituting the ink passage are separately arranged on the two passage plates 210 and 220 in the above description, this is only an exemplary embodiment and a variety of other ink passages and configurations may be provided on the inkjet printhead. For example, the passage plate may be formed of a single plate, more than two plates, etc. Accordingly, the present invention is not limited to the specific examples described herein.

The piezoelectric actuator 300 may be provided on a top surface of the first passage plate 210 to provide a driving force for forcing ink out of the pressure chamber 204. The piezoelectric actuator 300 may include a lower electrode 310 disposed on the top surface of the first passage plate 210, to function as a common electrode, a piezoelectric layer 320 disposed on the lower electrode 310, to be transformed by an applied voltage, and an upper electrode 330 disposed on the piezoelectric layer 320, to function as a driving electrode.

In detail, an insulating layer 212 may be formed between the lower electrode 310 and the first passage plate 210. The lower electrode 310 may be formed of a single conductive material layer applied on an overall top surface of the insulating layer 212. Alternatively, the lower electrode 310 may be formed of a titanium (Ti) layer and a platinum (Pt) layer. The lower electrode 310 may function as a common electrode and as a diffusion barrier layer, which prevents inter-diffusion between the first passage plate 210 and the piezoelectric layer 320. The piezoelectric layer 320 may be formed on the lower electrode 310 over the pressure chamber 204. The piezoelectric layer 320 is transformed by a voltage applied thereto, such that a vibration plate, i.e., a top of the pressure chamber 204, is elastically deformed. The piezoelectric layer 320 may be formed of a piezoelectric material, e.g., a lead zirconate titanate (PZT) ceramic material. The upper electrode 330 may be disposed on the piezoelectric layer 320 and function to apply a driving voltage to the piezoelectric layer 320.

The nozzle plate 100 may be formed on the bottom of the second passage plate 220 and define a nozzle 150. A nozzle 150 may be provided for each pressure chamber 204 and may communicate therewith by way of the damper 205, such that nozzle plate 100 includes a plurality of nozzles 150. The nozzle plate 100 may include a substrate 110 defining the nozzle 150, which may be tapered as it approaches the exit end. The substrate 110 may be formed of, e.g., a silicon wafer or an inexpensive base substrate for a PCB.

The nozzle plate 100 may include a heater 140 around the nozzle 150. In detail, each nozzle 150 may be provided with a heater 140 and an electrode 120 for operating the heater 140. The heater 140 may be disposed around the nozzle 150, i.e., each of the plurality of nozzles 150 may include a respective heater 140. The heater may be made of resistive heating material, e.g., TaAl, TaN, etc. The heater 140 and electrode 120 may be formed on a bottom surface of the substrate 110 and an insulating layer 130 may be formed thereon to cover the heater 140 and the electrode 120.

Referring to FIG. 5A, the heater 140 may include two arc-shaped heater segments 141 and 142 that are disposed around the nozzle 150. The two segments 141 and 142 may be located a predetermined distance from the nozzle 150. The two segments 141 and 142 may be independently operated to apply heat to ink in the nozzle 150. Accordingly, the surface tension of the heated ink may be varied such that droplets of ink can be ejected out of the nozzle 150 in a deflected direction. This deflection of the ink is described in greater detail herein.

The electrode 120 may be formed of a conductive material, e.g., a highly conductive metal such as copper (Cu), which may be advantageously combined with a PCB substrate. As shown in FIG. 5A, the electrode 120 may be provided in the form of a pattern that is connected to each of the two segments 141 and 142, such that the two segments 141 and 142 can be independently operated. The pattern of the electrode 120 is not limited to the shape or configuration illustrated in FIG. 5A and may have various shapes or configurations for connection with each of the two segments 141 and 142.

The insulating layer 130 may cover the heater 140 and the electrode 120 to protect and insulate them. The insulating layer 130 may be, e.g., an insulating material such as a photo solder resist (PSR), which is widely used as a PCB insulating material.

Figure 5B:
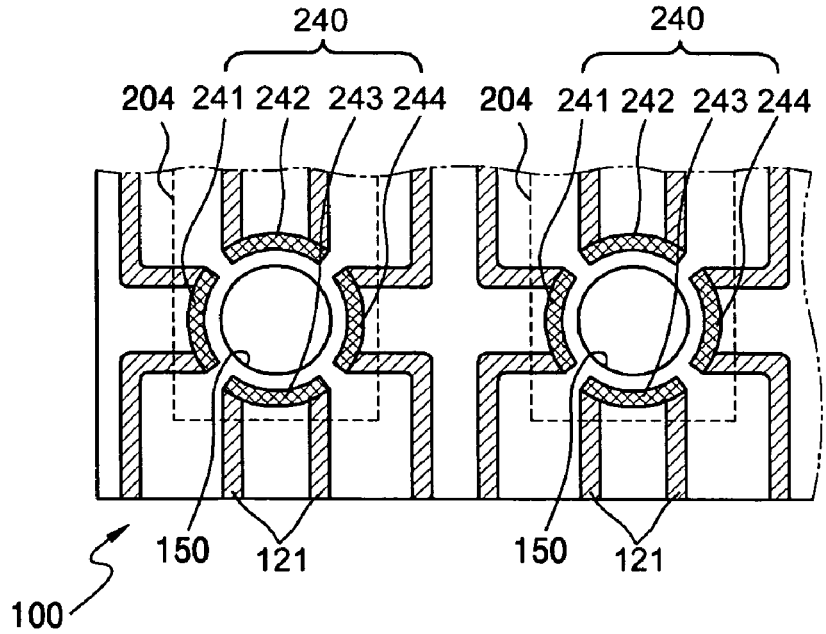
FIG. 5B illustrates an enlarged partial plan view of a heater that is provided on a nozzle plate according to another embodiment of the present invention.

FIG. 5B illustrates an enlarged partial plan view of a heater that is provided on a nozzle plate according to another embodiment of the present invention. Referring to FIG. 5B, a heater 240 may include four segments 241, 242, 243 and 244 that are arranged around the nozzle 150, e.g., at a regular interval such as 90°. Each of the four segments 241, 242, 243 and 244 may be arc-shaped. An electrode 121 may be patterned for connection with each of the four segments 241, 242, 243 and 244, such that the four segments 241, 242, 243 and 244 can be independently operated. The pattern of the electrode 121 is not limited to the shape or configuration illustrated in FIG. 5B and may be of various shapes and configurations suitable for connection with each of the four segments 241, 242, 243 and 244. Further, the heater is not limited to the shapes and configurations illustrated in FIGS. 5A and 5B and may be divided into two or more segments, e.g., three, five or six segments may be provided.

Figure 6A:
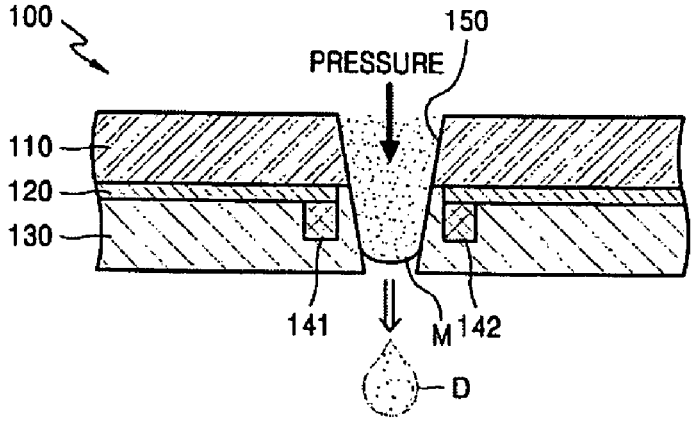
FIGS. 6A-6C illustrate sectional views of a deflection of ink droplets by a nozzle plate according to the present invention.
Figure 6B:
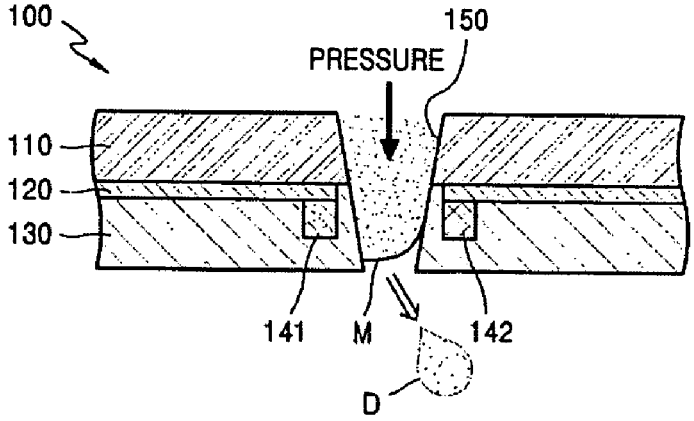
Figure 6C:
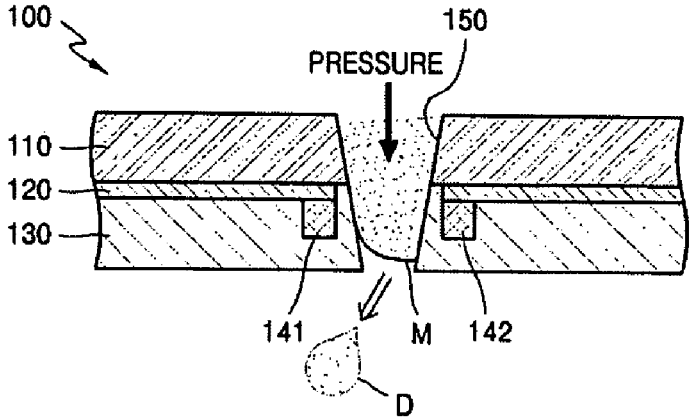

FIGS. 6A-6C illustrate sectional views of a deflection of ink droplets by a nozzle plate according to the present invention. In particular, FIGS. 6A-6C illustrate ink deflection by the nozzle plate with a two-segment heater, as depicted in FIG. 5A. Referring to FIG. 6A, when a current is not applied to first and second segments 141 and 142 of the heater 140, the segments 141 and 142 are not heated and thus the temperature of the ink in the nozzle 150 is uniformly maintained. In this case, the contact angle of the ink does not vary around the inner wall of the nozzle 150. Accordingly, a convex meniscus M is formed, as shown in FIG. 6A. That is, the meniscus M is symmetric with respect to the first and second heater segments. When pressure is applied to ink in the nozzle 150, e.g., by energizing the piezoelectric actuator 300, the ink is ejected from the nozzle 150 in the form of droplets. In particular, since the meniscus M is symmetric, the ink droplets D are ejected straight out of the nozzle 150.

FIG. 6B illustrates a case where ink is deflected. Referring to FIG. 6B, a current is applied to only the first segment 141 of the heater 140. Thus, heat is generated by the first segment 141, and ink adjacent to the first segment 141 is heated. However, ink that is not adjacent to the first segment 141 is not heated at all, or heated to a lesser degree. As a result, the viscosity and surface tension of the heated ink changes with respect to the ink that is not heated, or heated to a lesser degree. In particular, the viscosity and surface tension is reduced, changing the contact angle of the heated ink with the inner wall of the nozzle 150. Therefore, a meniscus M is formed that is asymmetric relative to the heater segments 141 and 142, as shown in FIG. 6B. In this case, when pressure is applied to ink in the nozzle 150, ink droplets are ejected from the nozzle 150 is deflected manner. That is, with respect to the arrangement illustrated in FIG. 6B, the ink droplets are ejected with a deflection to the right. Of course, spatially relative terms such as "right" are intended for descriptive purposes only, and various configurations of the present invention may be provided to deflect ink droplets in various directions.

The surface tension of the ink may be changed with a small amount of heat, such that the heater 140 may consume less power than, e.g., a heater of the conventional thermal inkjet printhead. For example, the surface tension of ink may be sufficiently changed by increasing the temperature of the ink by several tens of degrees Celsius.

Referring to FIG. 6C, when a current is applied to only the second segment 142, heat is generated by the second segment 142 and thus the ink adjacent to the second segment 142 is heated. Therefore, a meniscus M is formed that is asymmetric with respect to the heater segments 141 and 142, as shown in FIG. 6C. In this case, when pressure is applied to ink in the nozzle 150, ink droplets are ejected from the nozzle 150 and deflected to the left.

As described above, when a current is selectively applied to one of the segments 141 and 142 provided on the nozzle plate 100, the ejecting direction of the ink droplets may be deflected rightward or leftward. When, as illustrated in FIG. 5B, the heater 140 is divided into four segments 141, 142, 143 and 144, the ejection of ink droplets through the nozzle 150 may be varied in a greater number of directions.

Figure 7:
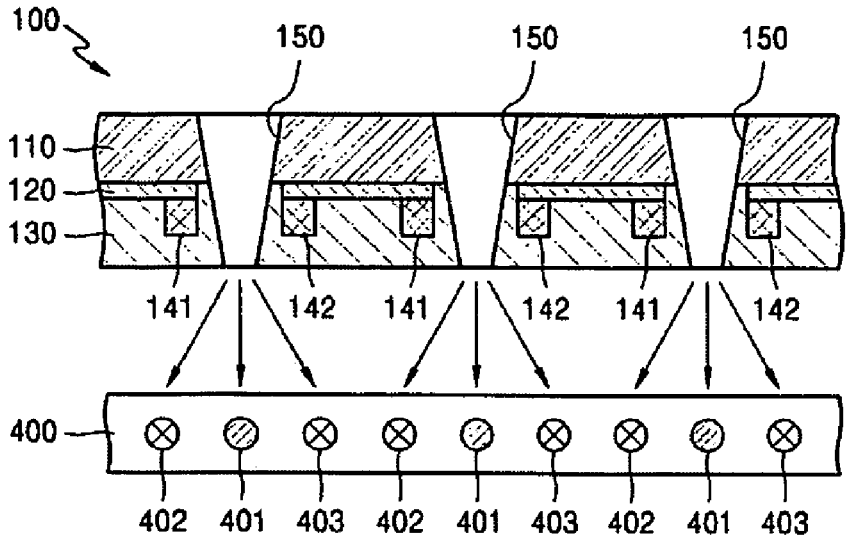
FIG. 7 illustrates a schematic view of a method of printing a higher resolution image using a nozzle plate of an inkjet printhead according to the present invention.

FIG. 7 illustrates a schematic view of a method of printing a higher resolution image using a nozzle plate of an inkjet printhead according to the present invention. Referring to FIG. 7, the plurality of nozzles 150 are arranged in the nozzle plate 100 at a predetermined CPI rate. When a current is selectively applied to the segments 141 and 142 of the heater 140 formed around the nozzle 150, the direction of ejection of ink droplets from the nozzle 150 may be varied.

In detail, printed dots 401 may be printed directly in front of the nozzle 150. That is, dots 401 may be printed by ink ejected straight from the nozzle 150, without deflection. Printed dots 402 and 403 may be printed offset from the nozzle 150. That is, dots 402 and 403 may be printed by ink that is deflected as it is ejected from the nozzle 150. Where segments 141 and 142 are arranged to the left and right of the nozzle 150, respectively, ink may be deflected so as to form a row of printed dots that are formed on a single line on a print medium 400, the dots spaced at a predetermined interval. As a result, in the example illustrated in FIG. 7, the DPI of the image formed on the print medium 400 may be three times the CPI of the nozzle plate 100.

Further, the nozzle plate 100 having the four-segment heater 140 depicted in FIG. 5B may be employed to eject the ink droplets in a greater variety of directions, allowing an image having a higher resolution to be printed using the nozzle plate 100 having a relatively low CPI.

A method of manufacturing the nozzle plate will be described hereinafter with reference to the accompanying drawings. FIGS. 8A-8F illustrate sectional views of stages in a method of manufacturing a nozzle plate according to the present invention. In these drawings, the nozzle plate is illustrated such that the completed unit is shown having the heater and electrode on the upper surface, though it will be appreciated that this is simply for ease of reference and does not limit the scope of the present invention.

Figure 8A:
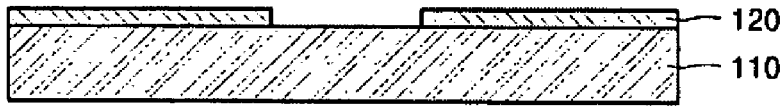
FIGS. 8A-8F illustrate sectional views of stages in a method of manufacturing a nozzle plate according to the present invention.

Referring to FIG. 8A, the substrate 110 is provided and the electrode 120 is formed on the substrate 110 in a predetermined pattern. In detail, as described above, the substrate 110 may be formed of a base substrate for the PCB and may include, e.g., polyamide. The electrode 120 may be formed of a conductive material, e.g., a highly conductive metal such as Cu. Thus, Cu may be deposited and etched in a predetermined pattern to form electrode 120.

Figure 8B:
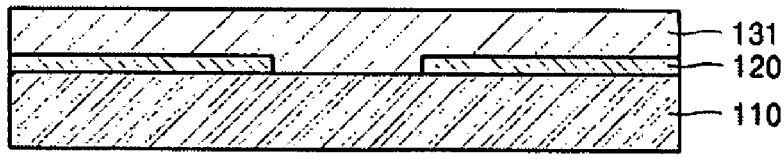

As illustrated in FIG. 8B, a first insulating layer 131 may be formed on the substrate 110 to cover the electrode 120, in order to protect and insulate the electrode 120. The first insulating layer 131 may be formed over the entire substrate 110 using, e.g., PSR.

Figure 8C:
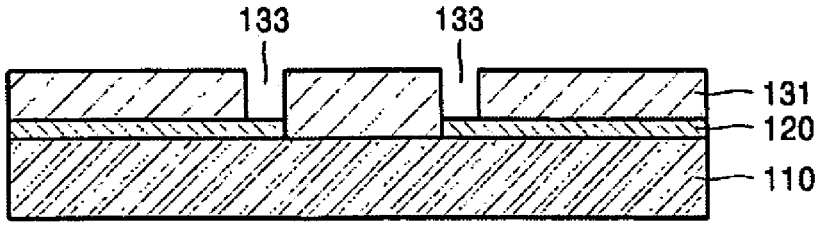

As illustrated in FIG. 8C, the first insulating layer 131 may be patterned to form, e.g., a trench 133, to thereby partially expose the electrode 120. The patterning of the first insulating layer 131 may be achieved by well-known photolithography processes, e.g., exposing, developing, etc. The trench 133 may be formed around a region where the nozzle 150 (refer to FIG. 8F) is to be defined in a subsequent stage. The trench 133 may be divided into two or more regions. That is, two or more separate trenches 133 may be formed.

Figure 8D:
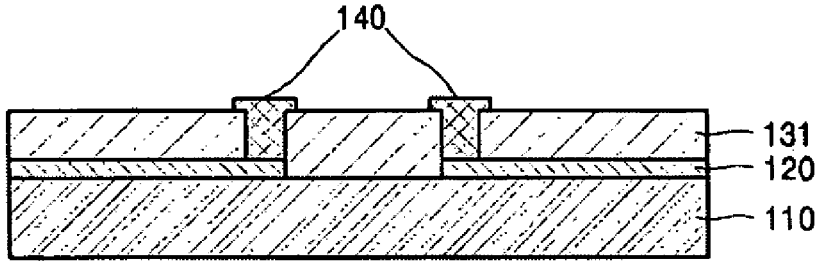

As illustrated in FIG. 8D, the heater 140 may be formed in the trench 133 by depositing a resistive heating material therein, e.g. TaAl, TaN, etc. The heater 140 may be formed as two or more segments corresponding to the trenches 133, such that discrete heater segments are formed.

Figure 8E:
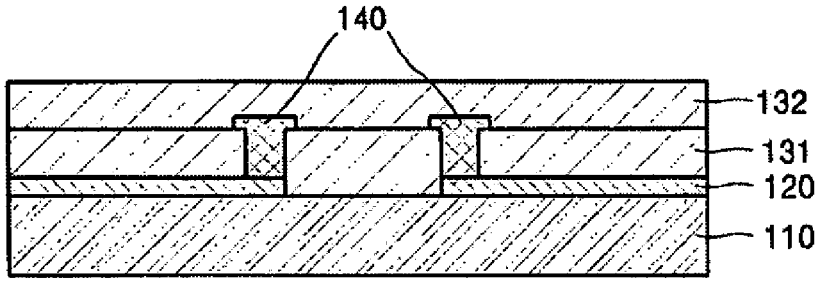

As illustrated in FIG. 8E, a second insulating layer 132 may be formed on the first insulating layer 131 to cover the heater 140, in order to protect and insulate the heater 140. As with the first insulating layer 131, the second insulating layer 132 may be formed of, e.g., PSR.

Figure 8F:
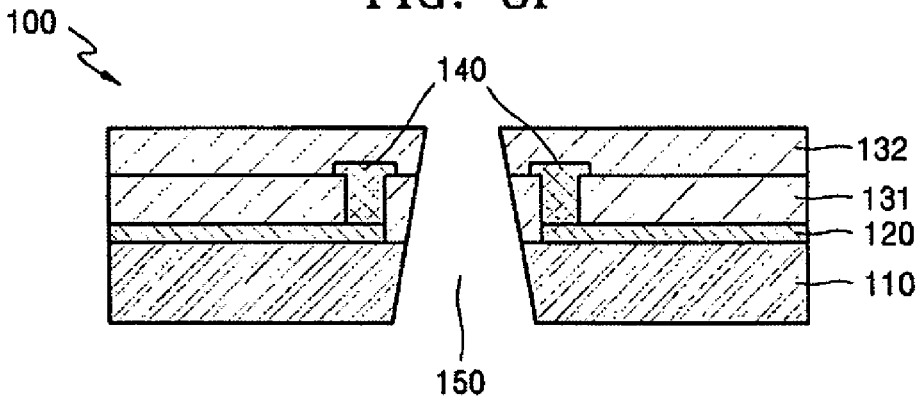

As illustrated in FIG. 8F, the nozzle 150 may be defined between the segments of the heater 140, through the substrate 110, the first insulating layer 131 and the second insulating layer 132, by using, e.g., a laser beam or drill.

As described above, the nozzle plate 100 of the present invention can be formed using a PCB base substrate through a PCB manufacturing process. That is, the nozzle plate 100 can be formed through a simple process with low cost.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An inkjet printhead comprising:

a passage plate including an ink passage having a plurality of pressure chambers;

a piezoelectric actuator formed on a surface the passage plate; and a nozzle plate formed on a surface of the passage plate and defining a plurality of nozzles coupled to corresponding ones of the plurality of pressure chambers, wherein the nozzle plate includes at least two heater segments disposed at intervals around a circumference of each of the plurality of nozzles.

2. The inkjet printhead as claimed in claim 1, wherein each of the at least two segments is independently operable.

3. The inkjet printhead as claimed in claim 2, wherein the nozzle plate includes four segments disposed at 90 degree intervals around the circumference of the nozzle.

4. The inkjet printhead as claimed in claim 2, wherein the nozzle plate further includes:

a substrate defining the plurality of nozzles and on which the heater segments are formed;

electrodes that are electrically coupled to the heater segments; and an insulating layer formed on the substrate and covering the heater segments and the electrodes.

5. The inkjet printhead as claimed in claim 4, wherein the insulating layer covers at least three surfaces of the heater segment.

6. The inkjet printhead as claimed in claim 4, wherein the substrate is formed of a base substrate for a printed circuit board.

7. The inkjet printhead as claimed in claim 4, wherein the heater segments are formed of a heat resistive material.

8. The inkjet printhead as claimed in claim 7, wherein the resistive heating material includes at least one of TaAl and TaN.

9. The inkjet printhead as claimed in claim 4, wherein the insulating layer is formed of photo solder resist.

10. The inkjet printhead as claimed in claim 1, further comprising:

ink in the ink passage; and a current supplier that selectively applies a current to only one heater segment of the at least two heater segments, wherein:

the ink heated by the one heater segment forms a meniscus that is asymmetric relative to the at least two heater segments.

11. The inkjet printhead as claimed in claim 10, wherein the ink is capable of being ejected from the nozzle in a deflected manner.

12. The inkjet printhead as claimed in claim 11, wherein there are two heater segments, and the ink is capable of being deflected in a rightward or a leftward direction.

13. The inkjet printhead as claimed in claim 1, further comprising:

ink in the ink passage; and a current supplier that selectively applies a current to at least one heater segment of the at least two heater segments, wherein:

the ink heated by the at least one heater segment forms a meniscus that is asymmetric relative to the at least two heater segments.

14. The inkjet printhead as claimed in claim 13, wherein the ink is capable of being ejected from the nozzle in a deflected manner.

15. The inkjet printhead as claimed in claim 14, wherein there are two heater segments, and the ink is capable of being deflected in a rightward or a leftward direction.

* * * * *